United States Patent [19]

Murphy

[11] Patent Number: 4,676,685

[45] Date of Patent: Jun. 30, 1987

[54] POWER BRUSH COATING APPLICATOR

[75] Inventor: Edward P. Murphy, Coon Rapids, Minn.

[73] Assignee: Graco Inc., Minneapolis, Minn.

[21] Appl. No.: 798,183

[22] Filed: Nov. 14, 1985

[51] Int. Cl.[4] ..... A46B 11/00; A46B 11/02; A46B 11/06

[52] U.S. Cl. ..... 401/285; 401/279; 401/287; 401/288; 401/289

[58] Field of Search ..... 401/261, 266, 279, 282, 401/283, 284, 285, 286, 287, 288, 289, 290

[56] References Cited

U.S. PATENT DOCUMENTS

| | | | |
|---|---|---|---|
| 823,458 | 6/1906 | Abbott . | |
| 1,254,701 | 1/1918 | Keplinger | 401/266 X |
| 1,335,671 | 3/1920 | Dunn . | |
| 1,342,211 | 6/1920 | Hainsey . | |
| 1,465,856 | 8/1923 | Marsh . | |
| 1,509,831 | 9/1924 | Gasparaitis | 401/283 |
| 1,968,062 | 7/1934 | Wood | 401/261 |
| 2,126,999 | 8/1938 | Mitchell | 15/128 |
| 2,127,000 | 8/1938 | Mitchell | 15/128 |
| 2,341,881 | 2/1944 | Rasch | 15/128 |
| 2,504,487 | 4/1950 | Anson | 401/285 X |
| 2,542,862 | 2/1951 | Epperson | 15/128 |
| 2,591,845 | 4/1952 | Magoon | 15/128 |
| 2,959,801 | 11/1960 | Pelham | 15/128 |
| 3,304,573 | 2/1967 | Stefely | 401/288 X |
| 3,335,450 | 8/1967 | Crompton | 401/207 |
| 3,371,980 | 3/1968 | Stefely | 401/289 X |
| 4,540,301 | 9/1985 | Swanson et al. | 401/279 X |

FOREIGN PATENT DOCUMENTS

| | | | |
|---|---|---|---|
| 547433 | 10/1957 | Canada | 401/288 |

*Primary Examiner*—Steven A. Bratlie
*Attorney, Agent, or Firm*—Paul L. Sjoquist

[57] ABSTRACT

A power brush coating applicator including a separable handle, valve housing and brush housing. A bristle assembly and flexible tapered insert are confined in sealing engagement in the applicator, the flexible insert having a plurality of capillary holes extending from an upper chamber to bottom openings aligned with a plurality of V-shaped slots. The V-shaped slots are supported by tapered ribs terminating at the slot ends, and the flexible insert is tapered to a plurality of closed ends bridging the shaped slots. The handle of the applicator is adapted for connection to a source of pressurized liquid and an interior liquid flow path is provided through a valve chamber and into flow communication with the capillary openings through the flexible insert.

11 Claims, 8 Drawing Figures

POWER BRUSH COATING APPLICATOR

BACKGROUND OF THE INVENTION

1. Field of the Invention

This invention relates generally to power brush coating applicators of the type that may be connected to a reservoir containing fluid, such as paint, under pressure to be applied to surfaces with the bristles of a brush. 2. Prior Art Paint brushes have long been in existence and have required that the bristles of a brush be dipped in fluid, or paint, in a container in almost precisely a correct manner to provide the correct amount of paint that may then be transferred to a surface to be coated. The deficiencies of this time consuming, labor intensive method of coating surfaces have led to many forms of alternative processes and devices for applying fluid to surfaces to be coated. The familiar paint spray apparatus has proven successful in a number of applications, and as noted below, a number of prior art patents are known to exist which relate to paint brushes that contain various and sundry forms of apparatus that may be used to connect the paint brush to a source of fluid under pressure to alleviate the time consuming, labor intensive process.

Examples of such devices may be seen in the following lists of prior art patents:

| Patent No. | Inventor | Issued |
|---|---|---|
| 823,458 | Abbott | 06/12/06 |
| 1,335,671 | Dunn | 03/30/20 |
| 1,342,211 | Hainsey | 06/01/20 |
| 1,465,856 | Marsh | 08/21/23 |
| 2,126,999 | Mitchell | 08/16/38 |
| 2,127,000 | Mitchell | 08/16/38 |
| 2,341,881 | Rasch | 02/15/44 |
| 2,542,862 | Epperson | 02/20/51 |
| 2,591,845 | Magoon | 04/08/52 |
| 2,959,801 | Pelham | 11/15/60 |

Thus it may be seen in the development of the prior art with which the present invention is concerned, painting brush devices have progressed from that which is shown in U.S. Pat. No. 823,458, issued in 1906, in which paint is applied at the upper end of the bristles of a brush assembly from a source of fluid under pressure.

As happens when using a conventional paint brush, the existence of paint at locations remote from the lower end or tips of the bristles creates problems in continuous use of the brush to apply a coating to a surface. Alternative arrangements for supplying fluid under pressure from the handle of a brush connected to a source are illustrated in the patents listed above which culminate in U.S. Pat. No. 2,591,845 issued in April of 1952 and which still contains a variation on a theme but lacks, at the least, a uniform distribution of paint across the width of the bristles in a brush at the desirable location, adjacent the ends of the bristles of the brush.

BRIEF DESCRIPTION OF THE INVENTION

As will be seen from a consideration of the appended detailed specification and drawings, the present invention presents an improved device in that a uniform distribution of paint from a reservoir of fluid under pressure is attained while the performance of the bristles in the brush is enhanced and an improved degree of control over the flow of the coating fluid is provided.

An improved fluid distribution element is added in the form of a pliable tapered insert having capillary-sized ducts extending from an upper end to a lower end and which is provided with slots intermediate outlets of the individual ducts so that fluid may flow from the outlet of the ducts near the lower tapered end of the insert and be distributed over the lower tapered end of the insert by coaction with the adjacent constantly moving bristles as the brush is applied to a surface whereby a uniform distribution of the fluid from the ends of the ducts to the surface of the lower end of the tapered insert and onto and into the bristles surrounding the insert is attained. The ducts are appropriately sized so as to create an internal back pressure so that fluid will not flow unless fluid under pressure is applied to the top ends of the ducts.

The power brush coating applicator is comprised of two elements that may be readily separated for cleaning and/or replacement.

Other features and advantages of the invention will become apparent from the consideration of the appended specification, claims and drawings in which:

DESCRIPTION OF THE PREFERRED EMBODIMENT

Figure 1:
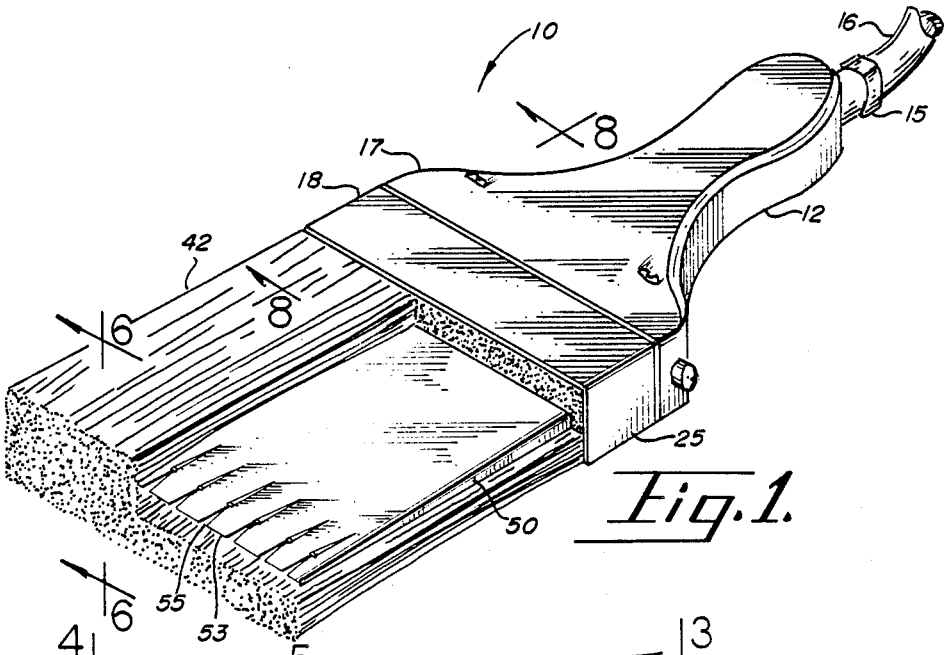
FIG. 1 is a perspective view (partly broken away) of a power brush coating applicator embodying the principles of the invention.
Figure 2:
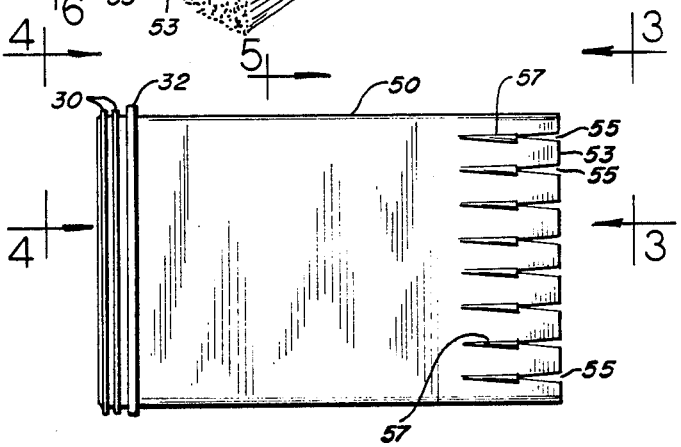
FIG. 2 is an elevational view of the insert.
Figure 5:
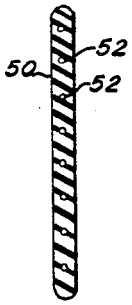
FIG. 5 is a sectional view taken along section line 5—5 on FIG. 2.
Figure 4:
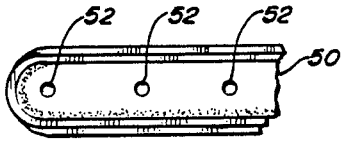
FIG. 4 is an enlarged fragmentary sectional view taken along section line 4—4 on FIG. 2.
Figure 3:
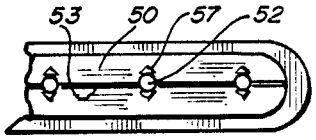
FIG. 3 is an enlarged fragmentary view taken along section line 3—3 on FIG. 2.
Figure 6:
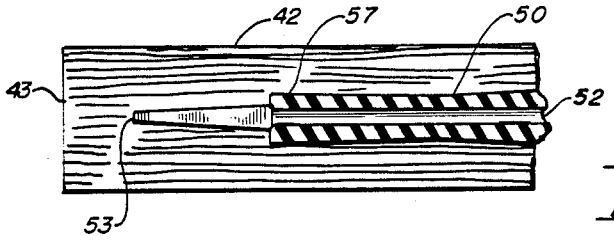
FIG. 6 is an enlarged sectional view taken along section line 6—6 on FIG. 1 of the drawings.
Figure 7:
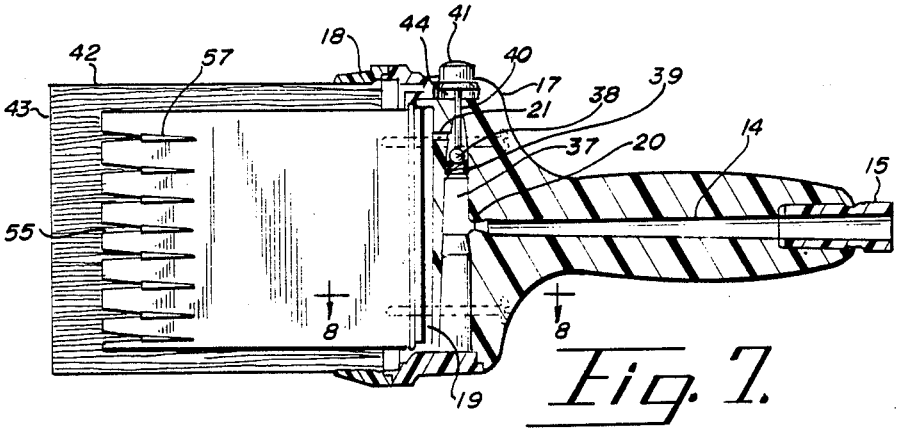
FIG. 7 is a side elevational view, partly in section, of a complete power brush coating applicator embodying the principles of the invention.
Figure 8:
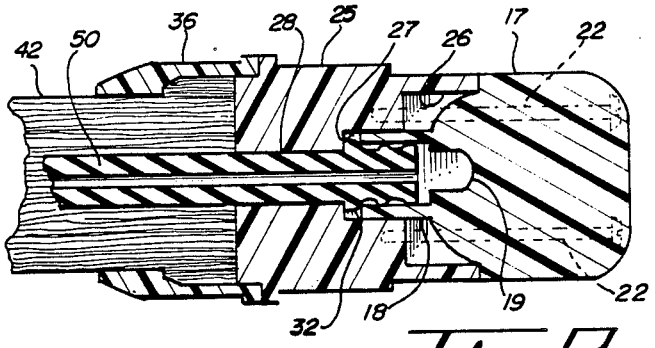
FIG. 8 is an enlarged sectional view taken along section line 8—8 on FIG. 7 of the drawings.

Referring to the drawings, a complete applicator is identified by reference character 10 and includes a handle 12 and a brush housing 25.

Handle 12, which may be comprised of suitable wood, plastic or metallic substance includes a bore 14 running from the top to the bottom that is provided with a connector 15 shown connected to a hose 16 that may be connected to a suitable source of fluid under pressure. The bottom of handle 12 has a downwardly extending valve housing 17 having a peripheral downwardly depending skirt portion 18 to define a chamber 19. Valve housing 17 is connected to bore 14 through a duct 20 and to chamber 19 through a further duct 21. Four holes 22 extend through the lower portion of handle 12 at appropriately disposed locations for receiving screws that extend downwardly into engagement with brush housing 25 to be described below.

Brush housing 25 is of generally rectangular configuration and includes a top opening 26 dimensioned to receive valve housing 17 and a lower recess 27 configured to receive skirt portion 18 on valve housing 17. The lower portion of recess 27 is provided with an elongated slot 28 for receiving the upper end of flexible insert 50. Brush housing 25 also includes a recess at its lower peripheral portion to receive the upper end of a ferrule 36.

A bristle ferrule 36 is shown disposed, mounted upon and affixed to the lower end of brush housing 25 at its top end that is configured to receive the recess on the bottom of brush housing 25. Ferrule 36 includes a downwardly extending bottom skirt and is dimensioned to receive and retain a hollow bristle assembly 42.

Flexible tapered insert 50 is comprised of soft pliable elastomer material such as plastic or rubber and includes a top end having a plurality of peripherally disposed ridges 30 adapted to fit in sealing engagement with the interior of skirt 18 on valve housing 17, and a further enlarged peripheral rib 32 spaced from the top and disposed to engage the top of lower recess 27 in brush housing 25 to form a seal for the lower end of chamber 19. A plurality of capillary passages 52 extend from the end of tapered insert 50 adjacent chamber 19 to the apex of the V-shaped slots 55. Capillary passages 52 are of relatively small diameter, preferably about 0.055 inch in the case of paint liquid viscosities. If the viscosity of the liquid is lower than typical paint viscosities the passages 52 should be made smaller. Insert 50 includes a plurality of V-shaped slots 55 opening between the major surfaces thereof, with the top portion of the slots 55 being in communication with holes 52 extending from the top to the bottom of tapered insert 50. A plurality of outwardly extending ribs 57 extend from proximate the top ends of slots 55 and extend upwardly in a reduced taper into the surface of flexible insert 50. Flexible insert 50 extends downwardly from the bottom of lower recess 27 in a gradual taper which terminates in a plurality of closed ends 53 bridging the V-shaped slots 55. Closed ends 53 are positioned inwardly of the bottom 43 of bristle assembly 42.

Valve housing 17 includes an interior valve chamber 37. A ball check 38 is constrained within chamber 37 by a compression spring 39, holding ball check 38 in sealing engagement against an end of chamber 37. A valve stem 40 is engaged against ball check 38 and extends outwardly to button 41. Button 41 is constrained in a bore 44, and may be moved inwardly a sufficient distance to cause valve stem 40 to unseat ball check 38.

In operation, a source of pressurized liquid is coupled to hose 16, thereby permitting the flow of liquid into bore 14 and valve chamber 37. The pressurized liquid is confined within valve chamber 37 until ball check 38 is unseated by depressing button 41. When button 41 is depressed ball check 38 becomes unseated to allow the flow of pressurized liquid through duct 21 into chamber 19. Chamber 19 is in flow communication with the top ends of the plurality of passages 52 which extend downwardly through flexible insert 50. Pressurized liquid therefore flows through passages 52 into V-shaped slots 55, and thereafter into the lower portion of bristle assembly 43. When applicator 10 is manipulated as a paint brush, bristle assembly 42 and flexible insert 50 are resiliently deflected when engaged against a wall surface or the like. The deflection of flexible insert 50 causes the pressurized liquid to flow outwardly through V-shaped slots 55 and to flow over the lower tapered end of flexible insert 50 and into bristle assembly 42, from where it is applied to the wall surface or the like as a coating. The operator may discontinue the painting process by releasing button 41, thereby halting the flow of pressurized liquid into flexible insert 50. Because passages 52 are very small in diameter, they act as capillary tubes, and therefore retain liquid which may be contained therein at the time button 41 is disengaged. The liquid in passages 52 is thereafter retained in passages 52 until such time as button 41 is again depressed, wherein the flow-through arrangement will continue. In this manner, applicator 10 does not drip liquid from the bottom 43 of bristle assembly 42 even though liquid may be contained within passages 52 during the painting process. However, if painting action is temporarily ceased and thereafter again started passages 52 will remain filled with liquid to enable the immediate flow of liquid through applicator 10 for smooth distribution to a wall surface or the like.

Applicator 10 is constructed for ease of disassembly and cleaning, because valve housing 17 may be opened by removing the fasteners which hold it together, and the various components forming the valving mechanism may be readily removed and cleaned. Likewise, flexible insert 50 may be removed from its seated position in applicator 10 and may be cleaned or replaced. Similarly, bristle assembly 42 may be removed for cleaning or replacement.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A liquid applicator brush for connection to a source of pressurized liquid, comprising:

(a) a handle having a bore therethrough and having a liquid coupling in said bore adapted for connection to a source of pressurized liquid;

(b) a first chamber in said handle in liquid flow communication with said bore, and a first passage opening into said chamber, and a recessed opening in an end of said handle in flow communication with said first passage;

(c) a liquid valve in said first chamber and positioned for selective opening and closing of said first passage, and means for selectively opening and closing said valve;

(d) a flexible insert having a first end seated into said recessed opening and a second end facing away from said opening, said insert having a narrowing taper toward said second end, said second end being closed with a plurality of spaced apart V-slots cut therein; said insert further comprising a plurality of second passages extending from said first end and respectively terminating and opening into respective apices in said V-slots at said second end;

(e) a bristle assembly about said flexible insert and extending beyond said second end of said insert; and (f) means for clamping said bristle assembly to said handle, including means for sealingly holding said flexible insert first end into said handle recessed opening.

2. The apparatus of claim 1, further comprising a plurality of tapered ribs on said flexible insert, each rib respectively positioned adjacent said V-slot, and having a narrowing taper toward said handle.

3. The apparatus of claim 2, wherein said plurality of second passages are of sufficiently small area as to prevent liquid flow therethrough without said liquid valve being positioned for selective opening of said first passage to pass pressurized liquid therethrough.

4. The apparatus of claim 3, wherein said liquid valve further comprises a ball check biased into closing relationship with said first passage.

5. The apparatus of claim 4, wherein said means for selectively opening and closing said valve further comprises a button having a face outside said handle and a stem between said button and said ball check.

6. The apparatus of claim 1, wherein said flexible insert further comprises a sealing rib about said first end, said sealing rib being sized for sealing engagement into said recessed opening.

7. The apparatus of claim 6, wherein said flexible insert is made from elastomer material.

8. The apparatus of claim 7, further comprising a plurality of tapered ribs on said flexible insert, each rib respectively positioned adjacent said V-slot, and having a narrowing taper toward said handle.

9. The apparatus of claim 8, wherein said plurality of second passages respectively have a diameter of about 0.05 inch.

10. The apparatus of claim 9, wherein said liquid valve further comprises a ball check biased into closing relationship with said first passage.

11. The apparatus of claim 10, wherein said means for selectively opening and closing said valve further comprises a button having a face outside said handle and a stem between said button and said ball check.

* * * * *